US010889948B2

(12) United States Patent
Winter

(10) Patent No.: US 10,889,948 B2
(45) Date of Patent: Jan. 12, 2021

(54) PLOW BLADE

(71) Applicant: Kent Winter, Willoughby, OH (US)

(72) Inventor: Kent Winter, Willoughby, OH (US)

(73) Assignee: Winter Equipment Company, Willoughby, OH (US)

( * ) Notice: Subject to any disclaimer, the term of this patent is extended or adjusted under 35 U.S.C. 154(b) by 0 days.

(21) Appl. No.: 15/409,056

(22) Filed: Jan. 18, 2017

(65) Prior Publication Data

US 2017/0191236 A1 Jul. 6, 2017

Related U.S. Application Data

(63) Continuation-in-part of application No. 14/847,943, filed on Sep. 8, 2015, now Pat. No. 9,562,342.

(60) Provisional application No. 62/046,366, filed on Sep. 5, 2014.

(51) Int. Cl.

| | |
|---|---|
| ***E01H 5/06*** | (2006.01) |
| ***E02F 3/815*** | (2006.01) |
| ***E02F 9/26*** | (2006.01) |
| ***E02F 9/28*** | (2006.01) |

(52) U.S. Cl.

CPC ..... *E01H 5/061* (2013.01); *E02F 3/8152* (2013.01); *E02F 9/26* (2013.01); *E02F 9/2883* (2013.01)

(58) Field of Classification Search

CPC ..... E02F 3/8152; E02F 3/8157; E02F 9/2883; E01H 5/061

USPC ..... 37/270

See application file for complete search history.

(56) References Cited

U.S. PATENT DOCUMENTS

| | | | | |
|---|---|---|---|---|
| 3,152,411 | A | 10/1964 | Wood | |
| 3,685,177 | A | 8/1972 | Hahn et al. | |
| 3,888,027 | A | 6/1975 | Toews | |
| 3,934,654 | A | 1/1976 | Stephenson et al. | |
| 4,607,781 | A * | 8/1986 | Shwayder | B23K 31/02 228/175 |
| 4,715,450 | A | 12/1987 | Hallissy et al. | |
| 4,770,253 | A | 9/1988 | Hallissy et al. | |
| 5,148,616 | A | 9/1992 | Maguina-Larco | |
| 5,224,555 | A * | 7/1993 | Bain | E02F 3/8152 172/701.3 |
| 5,553,409 | A | 9/1996 | Irving | |
| 5,724,755 | A | 3/1998 | Weagley | |
| 5,778,572 | A * | 7/1998 | Lukavich | E02F 9/285 172/701.3 |
| 5,813,474 | A * | 9/1998 | Manway | A01B 15/06 172/701.3 |

(Continued)

*Primary Examiner* — Gary S Hartmann

(74) *Attorney, Agent, or Firm* — Fay Sharpe LLP

(57) ABSTRACT

A plow blade edge system includes a plurality of wear bars mounted to a rear side of a plow blade section body. A first channel extends below each of the wear bars and is partially defined by the plow blade section body. Each where bar includes a weldment of carbide matrix along a bottom edge of the wear bar forming a first wear surface. The weldment of carbide matrix is retained in the first channel. The plow blade section body further includes a second channel formed in and extending along a bottom edge of the plow blade section body. The second channel is operative to receive at least one carbide insert and forms a second wear surface. A total surface area of the first wear surface exposed to the road surface is greater than a total surface area of the second wear surface exposed to the road.

15 Claims, 6 Drawing Sheets

(56) References Cited

U.S. PATENT DOCUMENTS

| | | | | |
|---|---|---|---|---|
| 5,881,480 | A * | 3/1999 | Fall | E02F 3/8152 172/701.3 |
| 6,041,529 | A | 3/2000 | Ruvang | |
| 6,854,527 | B2 | 2/2005 | Manway et al. | |
| 7,266,914 | B2 | 9/2007 | Grant | |
| 7,596,895 | B2 | 10/2009 | Jones | |
| 7,631,441 | B2 * | 12/2009 | Hunt | E01H 5/061 37/232 |
| 7,665,234 | B2 * | 2/2010 | Diehl | E02F 3/8157 172/701.3 |
| 7,765,726 | B2 | 8/2010 | Küper | |
| 7,836,615 | B2 | 11/2010 | Winter | |
| 7,874,085 | B1 | 1/2011 | Winter et al. | |
| 8,024,874 | B2 | 9/2011 | McClanahan et al. | |
| 8,191,287 | B2 | 6/2012 | Winter et al. | |
| 8,561,326 | B2 * | 10/2013 | Ruvang | E02F 3/401 37/452 |
| 8,844,173 | B2 | 9/2014 | Winter et al. | |
| 9,163,379 | B2 | 10/2015 | Winter | |
| 9,428,874 | B2 * | 8/2016 | Winter | E01H 5/061 |
| 9,562,342 | B2 * | 2/2017 | Winter | E02F 3/8157 |
| 9,821,396 | B2 * | 11/2017 | Winter | E01H 5/061 |
| 9,995,021 | B2 * | 6/2018 | Serrurier | E02F 9/2883 |
| 2007/0193755 | A1 * | 8/2007 | Kuper | E01H 5/061 172/701.3 |
| 2011/0162241 | A1 | 7/2011 | Wangsness | |
| 2012/0260537 | A1 | 10/2012 | Winter et al. | |
| 2015/0047234 | A1 | 2/2015 | Winter | |
| 2016/0039030 | A1 | 2/2016 | Winter | |
| 2017/0191236 | A1 * | 7/2017 | Winter | E01H 5/061 |
| 2017/0356165 | A1 * | 12/2017 | Serrurier | G06F 17/50 |
| 2018/0100279 | A1 * | 4/2018 | Aquino | E01H 5/065 |

* cited by examiner

PLOW BLADE

This continuation-in-part application claims the priority benefit of U.S. application Ser. No. 14/847,943, filed Sep. 8, 2015, the disclosure of which is incorporated herein by reference and which claims priority to U.S. Provisional Patent Application No. 62/046,366, filed Sep. 5, 2014, incorporated herein by reference in its entirety.

BACKGROUND

The present disclosure generally relates to devices for improving the durability, performance and operation of plow blades. Specifically, the present disclosure provides for an improved plow blade edge, for example, snow plow blade edge.

Rough terrain and cold weather conditions have caused problems for snow plow blades for as long as there have been snow plows. Although many modifications and alternative designs have been made to snow plow blades in attempts to improve the life, durability, and performance of snow plow blades, in particular, the life, durability, and performance of snow plow blade edges, most of these modifications and alterations did not provide sufficient durability and performance improvement to deal with, among other things, the rough terrain and cold weather that snow plow blades are typically exposed to. Typically, prior art snow plow edges include a continuous edge that is in contact with the road surface therebelow. The typical snow plow edges are subjected to extreme impact and wear and can be destroyed due to the wear from the contact between the plow edge and the terrain below.

In addition, rigid prior art snow plow blade edges, including a continuous bottom edge, can damage the surface over which they are moved. Due to their rigidity and continuous snow plow blade edge, prior art plow blades transmit loads to the surface below. The present disclosure describes a device with resilient construction material and method of mounting which can be used to provide new plow blade edges or replace worn plow blade edges, in particular, snow plow blade edges or other surface plows, that overcome many of the limitations of the prior art.

BRIEF DESCRIPTION

One aspect of the present disclosure provides for a plow blade including a plurality of plow blade sections. In one arrangement, each plow blade section includes a steel cover plate welded to a front side of the plow blade section body. Each plow blade section further includes a plow blade edge extending along a bottom edge of the steel cover plate. At least one cut-out forms an indentation extending across the steel cover plate. A plurality of wear bars can be mounted to a rear side of the plurality of plow blade sections. Each wear bar can include a weldment of carbide matrix along a bottom edge of the wear bar. Each cut-out extends across the steel cover plate to a top edge of a wear surface of the wear bar such that the carbide matrix is consumed as the plow blade edge retreats to the blade wear indicator.

Another aspect of the present disclosure provides for a plow blade edge system. In one arrangement, the plow blade edge system includes at least one steel cover plate welded to a front side of at least one plow blade section body. A plurality of wear bars can be mounted to a rear side of the plow blade section body. Each of the plurality of wear bars includes a weldment of carbide matrix along a bottom edge. The wear bars include a retainer late welded to a back side of the wear bars for forming a channel for receiving a deposit of the weldment of the carbide matrix.

Another aspect of the present disclosure provides for a plow blade edge kit for mounting to a mold board of a plow. The edge kit comprises a plurality of plow edge blades including mounting holes for mounting to a mold board. The kit further includes mounting bushings. The plow edge blades also include wear bar sections welded thereto.

Another aspect of the disclosure provides for a plow blade edge system. The plow blade edge system comprises a plurality of wear bars mounted to a rear side of a plow blade section body, wherein each of the plurality of wear bars includes a weldment of carbide matrix along a bottom edge forming a first wear surface. The plow blade section body includes a channel extending along a bottom edge of the plow blade section body and being operative to receive a plurality of carbide inserts forming a second wear surface, wherein a total surface area of the first wear surface is greater than a total surface area of the second wear surface.

DETAILED DESCRIPTION

Figure 1:
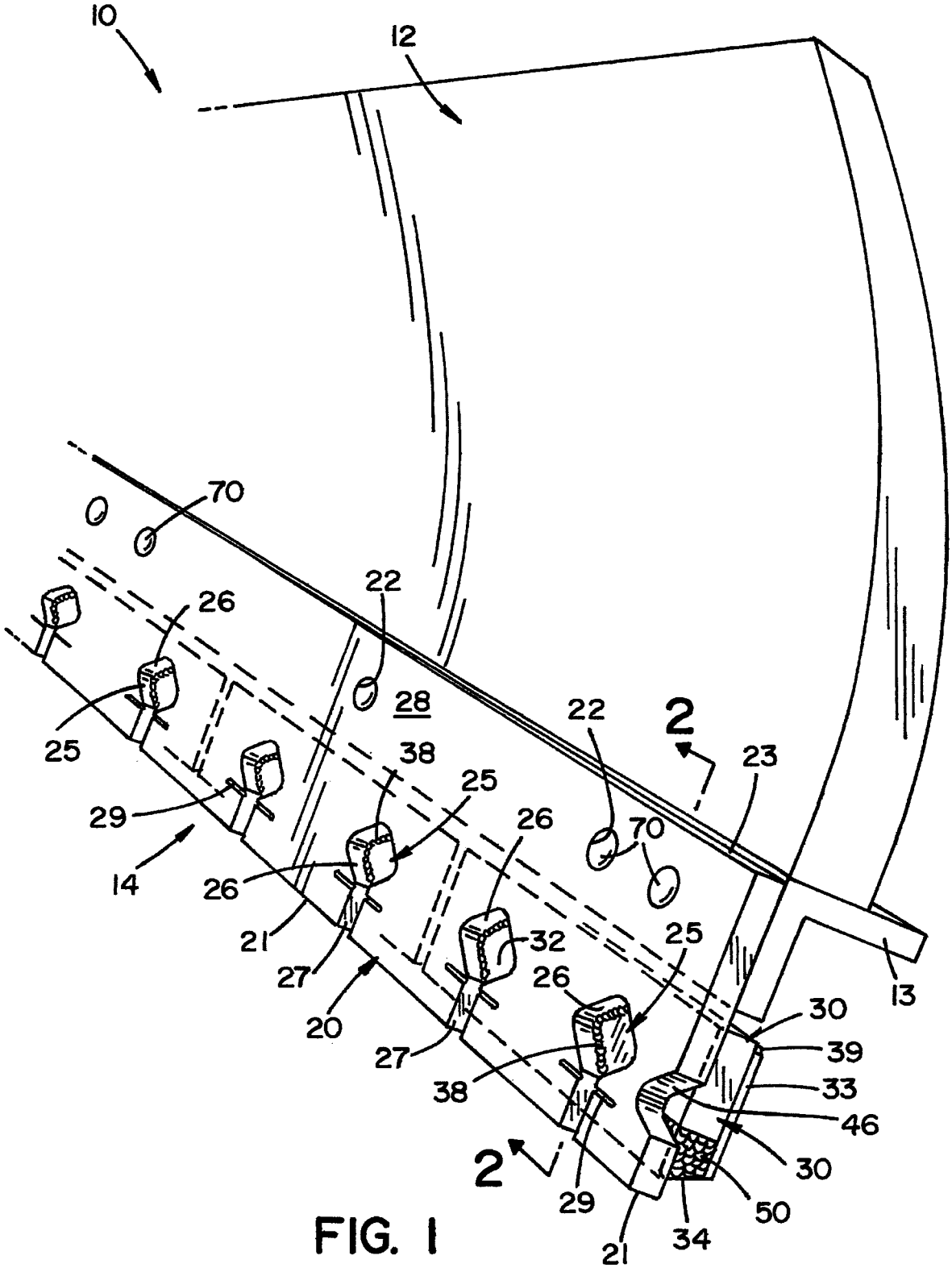
FIG. 1 is a front perspective view of a serrated blade section and plow blade edge system according to one aspect of the present disclosure.
Figure 5:
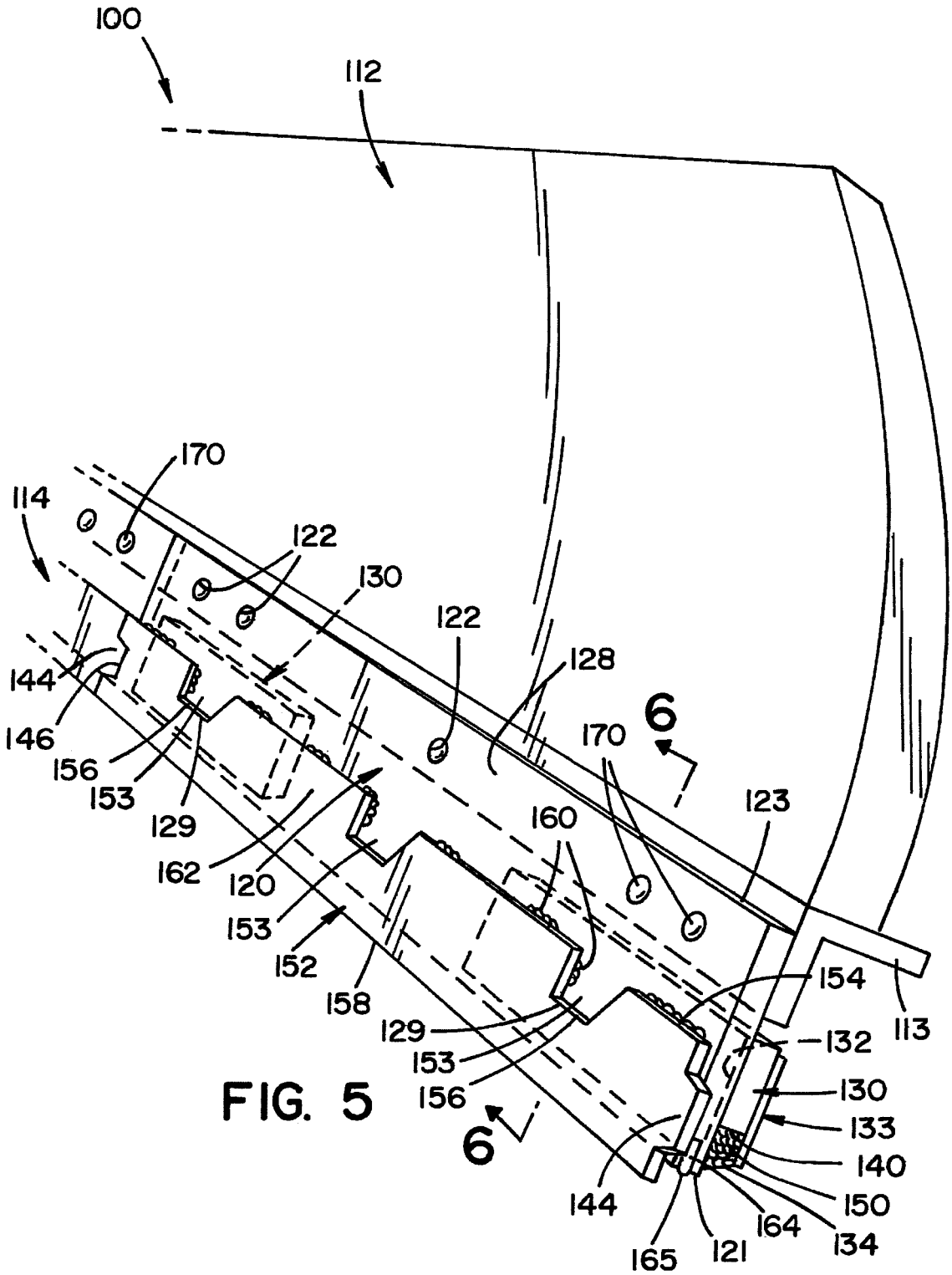
FIG. 5 is a front perspective view of a plow blade section and a plow blade edge system according to another embodiment of the present disclosure.

FIGS. 1 and 5 are perspective views of plow assemblies 10, 100 including plow bodies 12, 120 which can be hemispherical and funnel shaped steel construction, or other materials, for deflecting snow or other media. Plow assemblies 10, 100 are typically attached to a vehicle (not shown) by means of an appropriate frame or housing (also not shown). The vehicle may be any vehicle ranging from a standard car or pickup truck to a sand and salt carrying dump truck to a road grader having a belly mounted blade to huge earth moving or snow moving plows. The means of attaching plow bodies 12, 120 to a vehicle may also typically include some form of hydraulic mechanism for positioning plow assemblies 10, 100 as desired, as is typical in the art. The plow assemblies 10, 100 may also include one or more reinforcing members (not shown) to provide strength and rigidity to plow bodies 12, 120. Reinforcing members are typically standard structural angles which are attached to the back of plow bodies 12, 120, for example, by means of welding.

One embodiment of a plow blade edge system or kit 14 having wear resistant surfaces including serrated edge blades 20 and impact or wear bars 30, made in accordance with the teachings of the present disclosure, is illustrated in FIGS. 1-4. The wear bars 30, according to a first embodiment, include a mounting face 32 which can be secured to a backside 24 of the serrated blade 20. The wear bars 30 can be mounted close to a cutting edge 21 of the plow blade edge system 14. One of the advantages of the wear bars 30 is that they can be welded to the serrated blade 20 such that the serrated blade 20 and wear bars 30, can be combined all in a single plow blade edge system unit 14. It is to be appreciated that the present construction and assembly eliminates complicated and bulky supporting structures, additional mounting elements and thereby reduces the time and costs of fitting the plow blade edge system 14 onto the snow plow blade 12.

It is to be appreciated that the mounting openings 22 for the plow blade edge system 14 are located proximal to a top edge 23 of serrated blade 20 at a standard spacing of 8 inch or 12 inch centers. As shown, the serrated blade 20 can be mounted to a plow body base member or mold board 13 at the bottom of snow plow blade 12 having 12 inch bolt hole centers or other spaced mounting arrangements.

In one arrangement (FIGS. 3 and 4), the wear bars 30 are pre-mounted to the serrated blade 20. Wear surfaces 34 of wear bars 30 reside close to, and in general alignment with, the blade cutting edge 21 and are thus a more integral part of the blade system 14 and therefore, capable of absorbing more of the undesirable abrasive wear and vibration (i.e. in use).

At least one channel 40 can be formed between the serrated blade 20 and the wear bars 30 at the time of assembly. A carbide matrix wear pad or weldments 50 can be welded into the channel 40 to provide improved impact performance, wear resistance, and longer life to the plow blade edge system 14.

Figure 2:
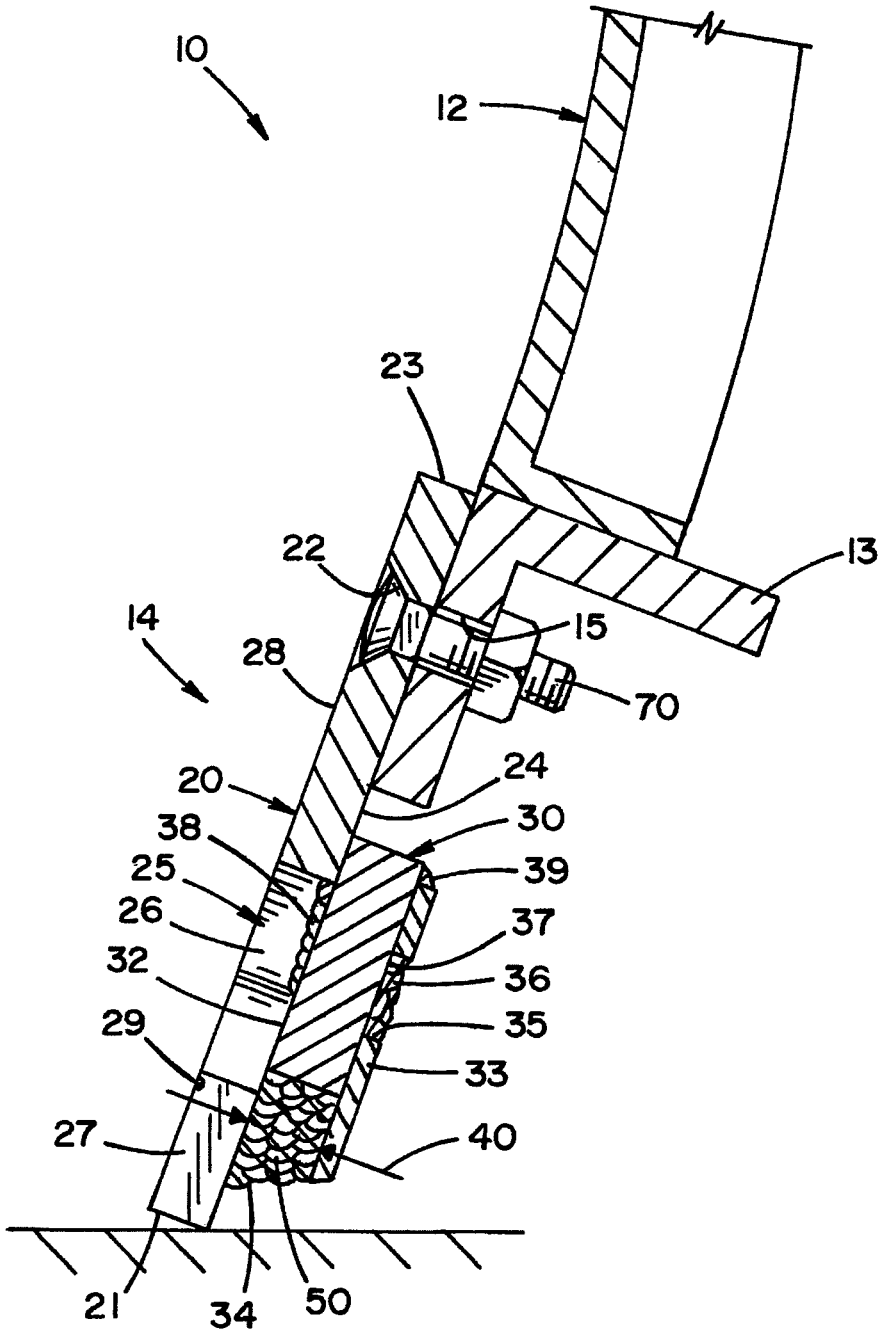
FIG. 2 is a cross sectional view taken along section lines 2-2 in FIG. 1 according to a first mounting arrangement of the plow blade system.

Subsequent to assembly, the channels 40 can be filled and/or overfilled by welding therein layered carbide matrix 50. The layered carbide matrix 50 can be composed of a series of layered deposits one on top of another until the channel 40 is filled or overfilled. Overfilling the channel 40 can result in a convex or bulbous layer of carbide matrix terminating beyond, i.e. extending below, the wear surface of the wear bar 30. The matrix 50 provides a reconstitutable embedded weldment or resistor for increased wear resistance of the wear surface. In one exemplary embodiment, one longitudinal channel 40 extends along substantially the length of the wear bar 30. As shown in FIG. 2, the welding deposit 50 (in an unworn state) in the channel 40 can overfill the channel forming substantially bulbous deposit extending outwardly from the wear or bottom surface of the wear bar 30.

The weldments 50 can be aligned with the wear surface such that when the plow assembly is in use and traveling along the road surface, the weldments 50 are transverse to the direction of travel. Alternatively, the weldments 50 can be aligned with or canted to, the direction of travel (not shown). The surface area of the weldments can comprise from about 35% to about 65% of the total surface area of the bottom wear surface comprising the serrated blade 20 and the wear bar 30.

The weld deposits 50 can have the following analysis (balance iron):

| C | Cr | Mo | Si | Mn | Hardness/Rc |
|---|---|---|---|---|---|
| X100<br>2.60 | X100<br>12.00 | X100<br>0.62 | X100<br>1.37 | X100<br>.77 | 55-60 |

Conventional hard-facing or wear-facing weldments can be used for the deposits 50. So-called chrome carbide steels are the most common, e.g., STOODY COMPANY NO. 121, although vanadium carbide (STOODY NO. 134) and tungsten carbide ones also can be used very effectively. It is to be appreciated that the weldment material 50 deposited in the channel 40 has a higher hardness than the surrounding materials. The weldment metal 50 must be abrasion-resistant. Generally, it is a high chrome ferrous metal weld. It is reconstitutable in the sense that it can be repaired or replaced by redeposition of carbide matrix by welding.

Weld deposit 50 in channel 40 can be transverse to the direction of travel. The wear surface and the embedded or integrated weldments 50 help to support the cutting edges of the serrated blade 20 and wear bars 30 such that the abrasive action and impact from the roadbed works on the weldments 50 and the serrated blade cutting edges 21, thereby substantially prolonging the life of the cutting edge 21 of serrated blade 20. The present edge system 14 of welded wear bars 30 and serrated blades 20 are intended to perform better than mechanically fastened solid carbide bars would under the extreme conditions of vibration, impact and thermal shock experienced by plow blades.

As described above, one aspect of the present disclosure provides for the plow blade edge system 14 to be easily mounted to a mold board 13 of a plow 12. The plow blade system 14 can comprise wear bars 30, serrated blades 20, and plow guards (not illustrated). The wear bar 30 can comprise a weldment of carbide matrix 50 built up along a bottom edge (i.e. deposited in a channel 40) for wear resistance. The carbide matrix 50 can comprise chrome carbide, tungsten carbide, or similar. The wear bar(s) 30 can be welded to respective serrated blades 20. The wear bars 30 can be positioned behind the serrated blades 20. The wear bar 30 can be comprised of a plurality of wear bar sections independently welded to the back of respective serrated blade sections 20, thereby forming plow guard like protection over nearly the entire length of the serrated blade 20. The wear bars 30 can also include steel retainer plates 33 for forming channels 40 between plates 33 and serrated blade 20, and for protection of the carbide matrix 50. The plow edge kit 14 further comprises a plurality of fasteners 70 that can pass through the holes 22 of the serrated blade 20, and corresponding holes 15 of the mold board 13 for securing the blade system 14 to the mold board 13.

Another aspect of the present disclosure provides for a plow blade edge kit 14 for mounting to the mold board 13 of a plow 12. The edge kit 14 comprises a plurality of serrated blade sections 20 including mounting holes 22 for mounting to a mold board 13. The kit 14 can further include mounting bushings. The serrated blades 20 also include wear bar sections 30 welded thereto.

Another aspect of the present disclosure provides for a serrated blade 20 having a plurality of cut-outs 25 (i.e. keyhole cut-outs) thereby forming a plurality of openings or channels 27 along the bottom edge 21 of the serrated blade 20. The serrated edge 21 can comprise self-sharpening high strength steel. The serrated blade edge 21 can cut through hard packed snow and ice easier than a continuous blade edge. The serrated blade 20 can be comprised of a plurality of blade sections (i.e. 2, 3 and/or 4 foot sections) including inter-locking terminal tabs for easy installation and positioning of adjacent sections. The cut-outs 25 can also include a wear indicator 29 (i.e. wear indicator line) that provides notice to the user that once the serrated blade edge 21 retreats and/or is consumed, to the wear indicator line 29, then the serrated blade 20 or blade section should be replaced.

The serrated blade 20 can be comprised of high strength steel. The blade 20 can be from about 4 in. to about 12 in. in height and from about 0.25 in. to about 1 in. in thickness. The serrated blades 20 can be made in predetermined lengths, i.e. 1 ft., 2 ft., 3 ft., and 4 ft. Plow guards optionally mounted to the front side of the serrated blade (not illustrated) can comprise carbide matrix along a lower edge welded into a channel. The plow guards can be installed where extra blade protection is needed. For curb protection, the plow guards can also comprise a curved section along an outer edge for protection of the blade edge from wear against a curb.

The keyhole cut-outs 25 of the serrated blade 20 can comprise a narrow channel 27 opened at a bottom edge 21 extending upward for a distance and then expanding into a relatively larger opening 26 at the top or terminal end of the keyhole opening 25. The open channel, i.e. plurality of open channels 27, along the serrated blade edge 21 and adjacent to the road surface provides for a more effective cutting plow edge that can cut effectively through hard packed snow and ice. The channel openings 27 along with the intermittent blade edge 21 therebetween provides for a more effective "slicing" ability such that the serrated blade edge 21 can tear and cut through the snow and ice as the plow assembly 10 is pushed along a road surface. The serrated edge 21 provides for increased "grab" of the material in front of the plow blade 12. The high points, i.e. the edge sections 21 in contact with the road surface will meet the snow and ice first, thereby putting more pressure per area available at these points. This allows the serration channels 27 to puncture and tear through the ice and snow faster. The serrated edge 21 can be a self-sharpening high strength steel blade edge. It is to be appreciated that in typical plowing operations, the plow blade 12 is angled relative to the direction of travel. Thus, the plow blade 12 is presented at an angle to the snow and ice as the plow blade 12 is pushed along. The typical angle of address enables the snow and ice to be dislodged from the road surface and then travel in a downstream manner to the right of the plow blade 12, thereby pushing the snow and ice to the right side of a road surface.

The wear bar sections 30 can each include a plurality of apertures 35 therethrough, for mounting of the retainer plate 33 to the wear bar 30. One arrangement can comprise plug welds 36 through the apertures 35, thereby making contact with a rear side 37 of the wear bar 30. In addition, fillet welds 39 can be provided for securing the retainer plate 33 to the wear bar 30. The enlarged head 26 of the keyhole cut-outs 25 can also include slot or fillet welds 38 along at least a portion thereof, thereby securing the serrated blade 20 to a front side 32 of the wear bar sections 30. It is to be appreciated that the fillet welds 38 are recessed from a front face 28 of serrated blade 20 and are shielded from abrasive action. The combination of the serrated blade 20 and the wear bar sections 30 can subsequently be mounted to the mold board 13.

It is to be appreciated that the serrated edge 21 results in a teeth like design along the lower edge that can easily penetrate the ice and packed snow as the plow blade 12, at a typical attack angle, is pushed along the roadway. The resultant action is a slicing cut as the plow blade 12 is presented at an angle to the substrate in front of the plow.

Each of the serrated blade sections 20 can include a male tab 44 and a female notch 46 at opposing ends for interlocking of adjacent serrated blade sections 20.

The number of serrated blade segments 20 mounted to a plow body will vary depending upon the size of plow body 12 used. For example, the length of the serrated blade 20 is limitless, but serrated blades 20 typically will have sections of 3 or 4 foot lengths. In this manner, any combination of two, or three, blade segments 20 can be combined to extend across a plow blade having a length of 6, 7, 8, 9, 10, 11, or 12 feet.

Figure 3:
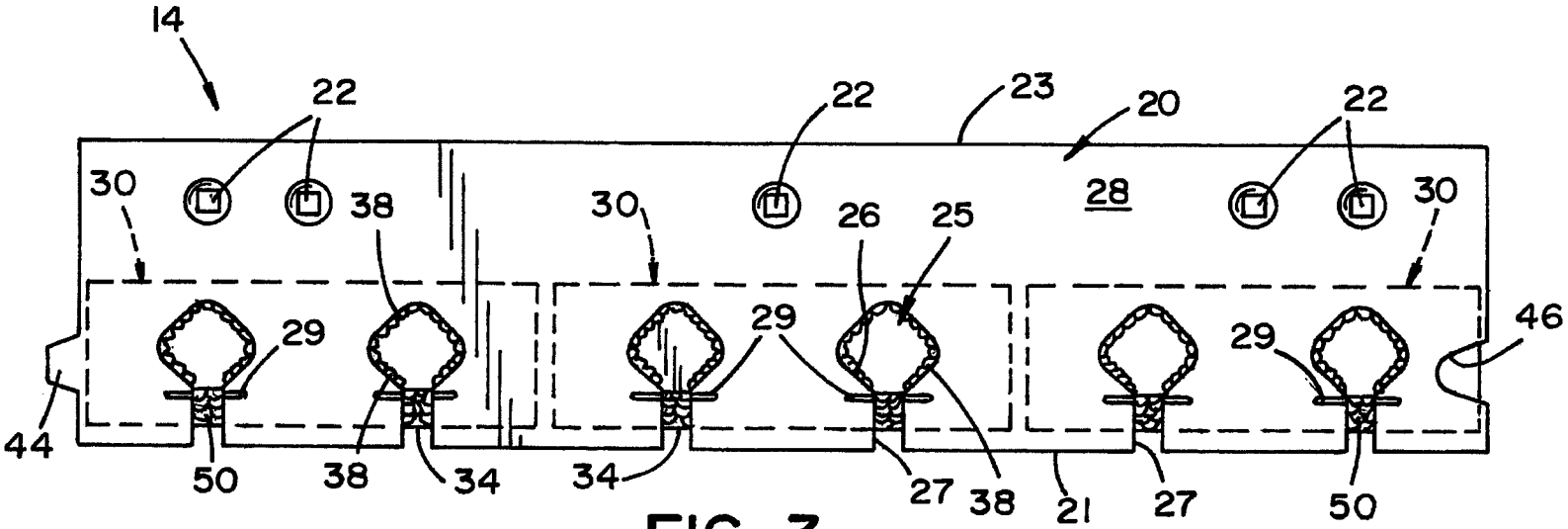
FIG. 3 displays a front view of the combination of plow guard serrated blade section and wear bar sections; and, FIG. 4 displays a rear view of the combination of plow guard serrated blade section and wear bar sections.
Figure 4:
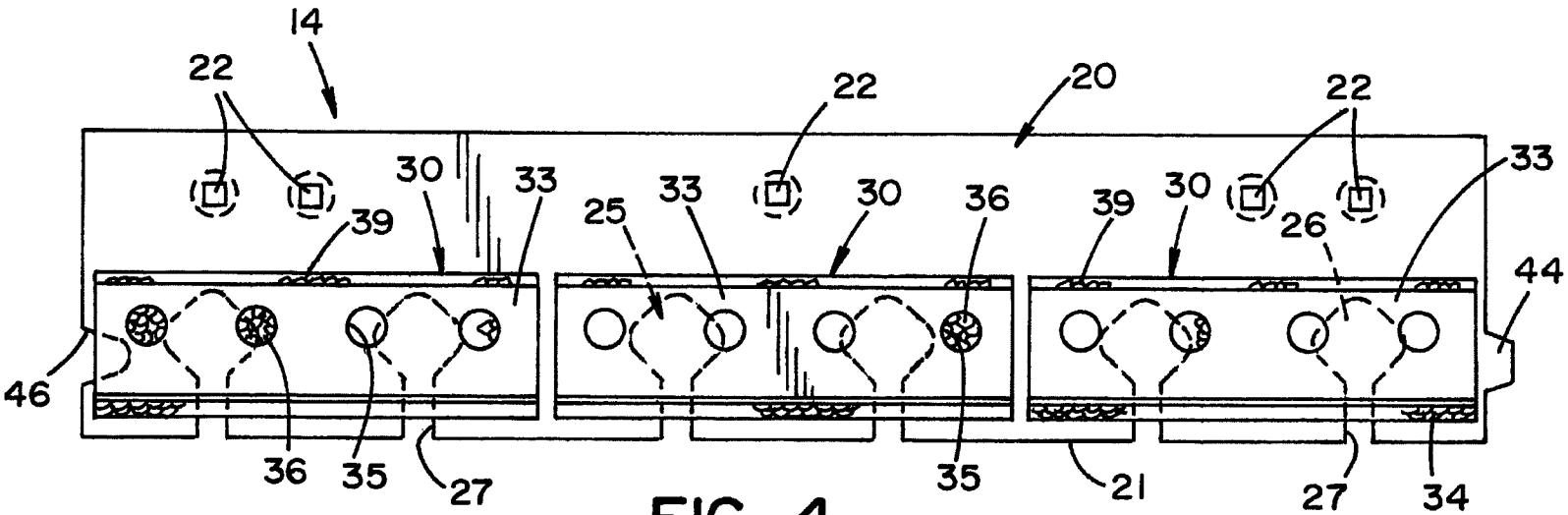

Referring now to FIG. 3, there is shown a wear termination or replacement line 29 on blade 20. The wear replacement line 29 indicates when the plow blade edge system 14 should be replaced. The wear line 29 can be reached, for example, when all, or substantially all, of the carbide matrices 50 have worn off, or abraded away. As described above, any number of combinations of serrated blade 20 exemplary lengths can be used to accommodate varying size of the plow blade body from 6 feet to 12 feet, et al. The end 44 of one blade 20 is designed to interlock an adjacent end 46 of another blade 20 thereby stabling the plow blade edge system 14. Thus, the male interlock section 44 of one blade 20 can be interlocked with the female section 46 of another adjacent interlock blade 20. The male 44 and female 46 interlock sections overlap a joint of adjacent blades thereby stabilizing the serrated blade 20 sections. In conjunction therewith, one or more integral plow blade edge sections 14 can be independently mounted or replaced. In this manner, one person can single-handedly replace one (or more) integral plow blade edge sections 14 as needed in one simple section swap.

Another embodiment of a plow blade edge system or kit 114 having wear resistant surfaces including plow edge blades 120 and impact or wear bars 130, made in accordance with the teachings of the present disclosure, is illustrated in FIGS. 5-8. The wear bars 130, according to the illustrated embodiment, include a mounting face 132 which can be secured to a backside 124 of the plow edge blade 120. The wear bars 130 can be mounted close to bottom edges of the plow blade edge system 114. One of the advantages of the wear bars 130 is that they can be welded to the plow edge blade 120 such that the plow edge blade 120 and wear bars 130, can be combined all in a single plow blade edge system unit 114. It is to be appreciated that the present construction and assembly eliminates complicated and bulky supporting structures, additional mounting elements and thereby reduces the time and costs of fitting the plow blade edge system 114 onto the snow plow blade 112.

It is to be appreciated that the mounting openings 122 for the illustrated plow blade edge system 114 can be located proximal to a top edge 123 of plow edge blade 120 at a standard spacing of 8 inch or 12 inch centers. As shown, the plow edge blade 120 can be mounted to a plow body base member or mold board 113 at the bottom of snow plow blade 112 having 12 inch bolt hole centers or other spaced mounting arrangements.

In one arrangement (FIGS. 7 and 8), the wear bars 130 are mounted to the plow edge blade 120. Wear surfaces 134 of wear bars 130 reside close to, and in general alignment with, the blade cutting edge 121 and are thus a more integral part of the blade system 114 and therefore, capable of absorbing more of the undesirable abrasive wear and vibration (i.e. in use).

At least one channel 140 can be formed by a mounted retainer plate 133 extending below the wear bar 130 at the time of manufacture. A carbide matrix wear pad or weld deposit 150 can be welded into the channel 140 to provide improved impact performance, wear resistance, and longer life to the plow blade edge system 114.

The channels 140 can be assembled and filled using the same procedure described supra for the plow blade edge system 14 illustrated in FIGS. 1-4. Similarly, the composition forming the carbide matrix 150 can include the same weld deposits (50) and properties described above for FIGS. 1-5. In this manner, the wear surface and the embedded or integrated weldments 150 help to support the cutting edges of the plow edge blade 120 and wear bars 130 such that the abrasive action and impact from the roadbed R are resisted by the weldments 150, thereby substantially prolonging the life of the cutting edge 121 of plow edge blade 120. The present edge system 114 of welded wear bars 130 and plow edge blades 120 are intended to perform better than mechanically fastened solid carbide bars would under the extreme conditions of vibration, impact and thermal shock experienced by plow blades.

Returning to FIGS. 5-8, further aspects of the present disclosure provide for the plow blade edge system 114 to be easily mounted to a mold board 113 of a plow 112. The plow blade system 114 can comprise wear bars 130, plow edge blades 120, and plow guards (not illustrated). The wear bar 130 can comprise the weldment of carbide matrix 150 built up along a bottom edge (i.e. deposited in the channel 140) for wear resistance. The carbide matrix 150 can comprise chrome carbide, tungsten carbide, or similar material. The wear bar(s) 130 can be welded to respective plow edge blades 120. The wear bars 130 can be positioned behind the plow edge blades 120. In one exemplary arrangement, a four (4) foot length plow blade 120 can include three (3) wear bars 130 welded to the back. A three (3) foot length plow blade 120 can include two (2) wear bars 130 welded to the back. It is contemplated that four (4) foot and three (3) foot plow blades can each include from one (1) to four (4) wear bars (not shown). The wear bar 130 can be comprised of a plurality of wear bar sections independently welded to the back of respective plow edge blade sections 120, thereby forming plow guard like protection over nearly the entire length of the plow edge blade 120. The wear bars 130 can also include the steel retainer plates 133 for defining channels 140 between plates 133 and plow edge blade 120, and for retention of the carbide matrix 150 during manufacturing. The plow edge kit 114 further comprises a plurality of fasteners 170 that can pass through the holes 122 of the plow edge blade 120, and corresponding holes 115 of the mold board 113 for securing the blade system 114 to the mold board 113.

Another aspect of the illustrated embodiment provides for a plow blade edge kit 114 for mounting to the mold board 113 of a plow 112. The edge kit 114 comprises a plurality of plow blade sections 120 including mounting holes 122 for mounting to a mold board 113. The kit 114 can further include mounting bushings. The plow blades 120 also include wear bar sections 130 welded thereto.

Another aspect of the illustrated embodiment provides for a steel cover plate 152 welded to a front face 128 of the plow edge blade body 120. The steel cover plate 152 includes a plurality of generally spaced apart cut-outs 153 (inverse teeth) extending along a top edge portion 154 of the steel cover plate 152. Each cut-out 153 thereby forms an indentation or groove extending approximately across the steel cover plate 152 to approximately a top edge of the wear surface of the wear bar 130. Each cut-out 153 functions as a wear indicator 129 that provides notice to the user that once the plow blade edge 121 (and the wear surface 134 of the impact wear bar 130) retreats and/or is consumed to a bottom edge of the wear indicator 129 (i.e., wear indicator line 156), then the plow blade edge kit 114 or blade system should be replaced.

Another aspect of the illustrated embodiment (FIGS. 5-8) provides for a reinforcing carbide wear surface comprising a plurality of carbide inserts 164 along a bottom edge of the plow edge blade body 120, which is situated between the steel cover plate 152 and the wear bar 130. The carbide inserts 164 can have a variety of dimensions. In one exemplary arrangement, the carbide inserts 164 range in length from 0.375 in. to 1.50 in., and can range in height from 0.25 in. to 1.5 in. The plow edge blade body 120 can include a channel 166 formed therein at the time of assembly to receive the plurality of carbide inserts 164. The carbide inserts 164 can be fluxed and brazed into the channel 166 to provide improved impact performance, wear resistance, and longer life to the plow blade edge kit or system 114. Alternatively, the carbide inserts can be epoxied into the channel. The carbide inserts can comprise a variety of shapes and configurations. Exemplary shapes and configurations include bull nose (FIG. 6), trapezoidal, rectangular, et al., and/or combinations thereof.

Wear surfaces 134, 165 of the respective embedded, integrated, or brazed weldments and inserts 150, 164 increase the amount of abrasion resistant material in contact with the road surface R and help to support the bottom edges of the plow blade 120, cover plate 152, wear bars 130, and retainer plate 133 such that the abrasive action and impact from the roadbed R are resisted by the weldments and inserts 150, 164, thereby substantially prolonging the life of the plow blade edge system 114. The present blade system 114 comprising welded wear bars 130 and plow blades 120 are intended to perform better than mechanically fastened solid carbide bars would under the extreme conditions of vibration, impact and thermal shock experienced by plow blades.

Figure 6:
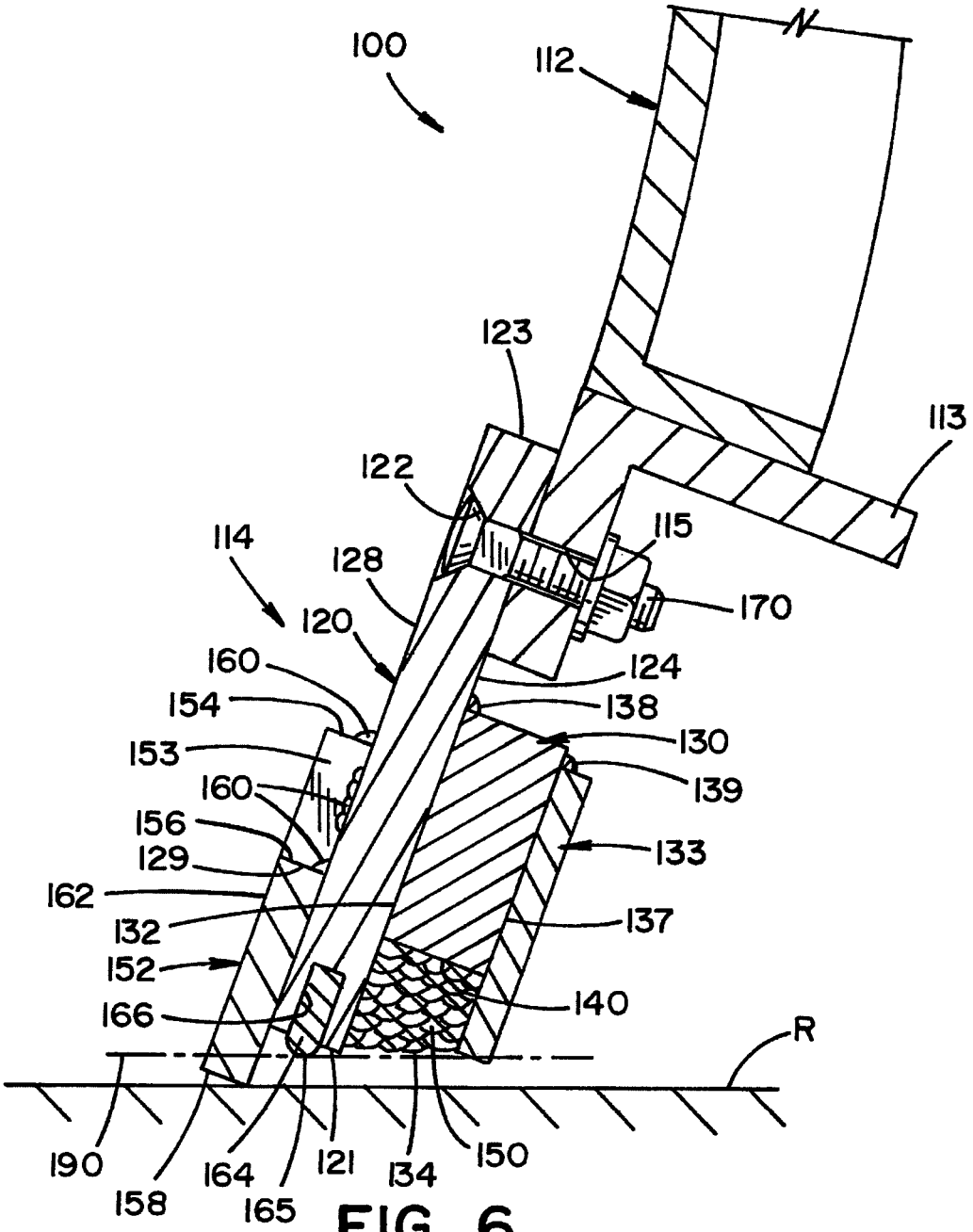
FIG. 6 is a cross sectional view taken along section line 6-6 in FIG. 5 according to a first mounting arrangement of the plow blade edge system shown in FIG. 5.

It is to be appreciated that the total surface area exposed to the road surface R of carbide matrix 150 is from about 1.0 to about 3.0 times the total surface area exposed to the road surface R of the carbide inserts 164. In another embodiment, the total surface area exposed to the road surface R of carbide matrix 150 is from about 1.5 to about 2.2 times the total surface area of the carbide inserts 164. In yet still another embodiment, the total surface area exposed to the road surface R of carbide matrix 150 is from about 1.7 to about 2.1 times the total surface area of the carbide inserts 164. It is further to be appreciated that the combination of blades 120, 130, and 133, i.e. the ground engaging boundary of the combined blades, comprise an overall 'footprint' or outline area relative to the road surface. The ground engaging boundary or outline area can be defined by the thickness of blades 120, 130, and 133 times the respective lengths of the blades 120, 130, and 133. In one embodiment, the combined surface areas of carbide matrix 150 and carbide inserts 164, exposed to the road surface R, is from about 45 percent to about 75 percent of the outline area. In another embodiment, the combined surface areas of carbide matrix 150 and carbide inserts 164, exposed to the road surface R, is from about 55 percent to about 70 percent of the outline area. In yet still another embodiment, the combined surface areas of carbide matrix 150 and carbide inserts 164, exposed to the road surface R, is from about 65 percent to about 70 percent. As shown, the carbide matrix 150 is non-contiguous with the carbide inserts 164. The aforementioned concentration of hardened wear surfaces, relative to the overall 'footprint' not only provides for effective wear resistance but also provides improved cutting ability as the plow edge system moves through packed snow and ice. As shown in FIGS. 5 and 6, the volume of total carbide (i.e. combined volume of carbide matrix 150 and combined volume of bullnose carbide inserts 164) represents an increase from about 2.5 times to about 4.0 times the volume of carbide of a plow edge system that does not include wear bars.

It is to be appreciated that the blades 120, carbide inserts 164, wear bars 130, carbide matrix 150, and retainer plate 133 provide a combined weight relative to the respective 'footprint' of the aforementioned components. The relationship of the combined weight to the respective 'footprint' creates a resultant pounds per square inch (PSI). In one exemplary embodiment, the resultant PSI is from about 1.00 PSI to about 1.80 PSI. In a further embodiment, the resultant PSI is from about 1.20 PSI to about 1.60 PSI. In yet still another embodiment, the resultant PSI is from about 1.30 PSI to about 1.55 PSI.

A plow blade edge extends along a bottom edge 158 of the steel cover plate 152. The plow edge 158 can comprise self-sharpening high strength steel. The plow blade edge 158 can cut through hard packed snow. The illustrated plow blade edge 158 is generally continuous across a plurality of blade sections (i.e. 2, 3 and/or 4 foot sections) including inter-locking terminal tabs for easy installation and positioning of adjacent sections. Although, embodiments are contemplated where the steel cover plate 152 is serrated, or includes a plurality of serrated blade sections, as described supra for the illustrated embodiment of FIGS. 1-4.

The plow edge blade 120 and the steel cover plate 152 can be comprised of abrasion-resistant high strength steel that will not break. The blade 120 can be from about 4 in. to about 12 in. in height and from about 0.25 in. to about 1 in. in thickness. The steel cover plate 152 can be from about 2 in. to about 5 in. in height and from about ⅜ in. to about ⅞ in. in thickness. The plow edge blades 120 can be made in predetermined lengths, i.e. 1 ft., 2 ft., 3 ft., and 4 ft. and sections of different lengths can be combined to create a plow edge blade of a desired overall length. Plow guards optionally mounted to the plow blade 120 along a front side of the steel cover plate 152 (not illustrated) can comprise carbide matrix along a lower edge welded into a channel. The plow guards can be installed where extra blade protection is needed. For curb protection, the plow guards can also comprise a curved section along an outer edge for protection of the blade edge from wear against a curb. The wear bars with carbide matrix 150, along with the carbide inserts 164, can comprise from about 3.0 lbs./ft. to about 4.5 lbs./ft. of the carbide matrix protection.

In the illustrated embodiment, fillet welds 139 can be provided for securing the retainer plate 133 to the wear bar 130. Furthermore, fillet welds 138 can be provided for securing the wear bar 130 to the back side 124 of the plow edge blade 120. Additionally, fillet welds 160 can be provided for securing the steel cover plate 152 to a front side 128 of the plow blade body 120. It is to be appreciated that the fillet welds 160 are recessed from a front face 162 of the steel cover plate 152 and are shielded from abrasive action. However, embodiments are contemplated where the retainer plate 133 can include a plurality of apertures therethrough (not shown), for mounting of the retainer plate 133 to the wear bar 130. One arrangement (not illustrated) can comprise plug or puddle welds through the apertures, thereby making contact with a rear side of the wear bar. In a similar manner, embodiments are contemplated (not illustrated) where the plow blade body includes a plurality of apertures therethrough for mounting the wear bar 130 to the plow blade 120. The combination of the plow edge blade 120 and the wear bar sections 130 can subsequently be mounted to the mold board 113.

It is to be appreciated that the bottom edges of the plow blade 120, cover plate 152, wear bars 130, and retainer plate 133, through use, will 'burn' or wear into a continuous and generally rectilinear lower edge surface 190 that can easily penetrate the ice and packed snow as the plow blade 112, at a typical attack angle, is pushed along the roadway R. The resultant action is a slicing cut as the plow blade 112 is presented at an angle to the substrate in front of the plow. However, in another contemplated embodiment (not illustrated), the leading edge 158 can represent a teeth-like design along a serrated lower edge of the steel cover plate that can also easily penetrate the ice and packed snow.

As best shown in FIG. 6, the bull nose inserts 164 have initially a curvilinear ground engaging surface. The initial surface represents a linear alignment identified at the apex 165 of each carbide insert 164. It is to be appreciated that linear surface 165 will readily self-align with planar surface 134 as the respective blades 'burn' or wear into the lower edge surface 190. Wear surface 165 will move from a linear surface to a self-aligned planar surface (aligned with surface 134) as wear progresses. The initial linear arrangement of surface 165 to planar surfaces 134 facilitates, not only forward motion of plow body 112, but also rearward motion (i.e., back-dragging).

The number of plow blade segments 120 mounted to a plow body 112 will vary depending upon the size of plow body 112 used. For example, the length of the plow blade 120 is limitless, but typically will have sections of 3 or 4 foot lengths. In this manner, any combination of two to five blade segments 120 can be combined to extend across a plow blade having an overall length of 6, 7, 8, 9, 10, 11, or 12 feet.

Figure 7:
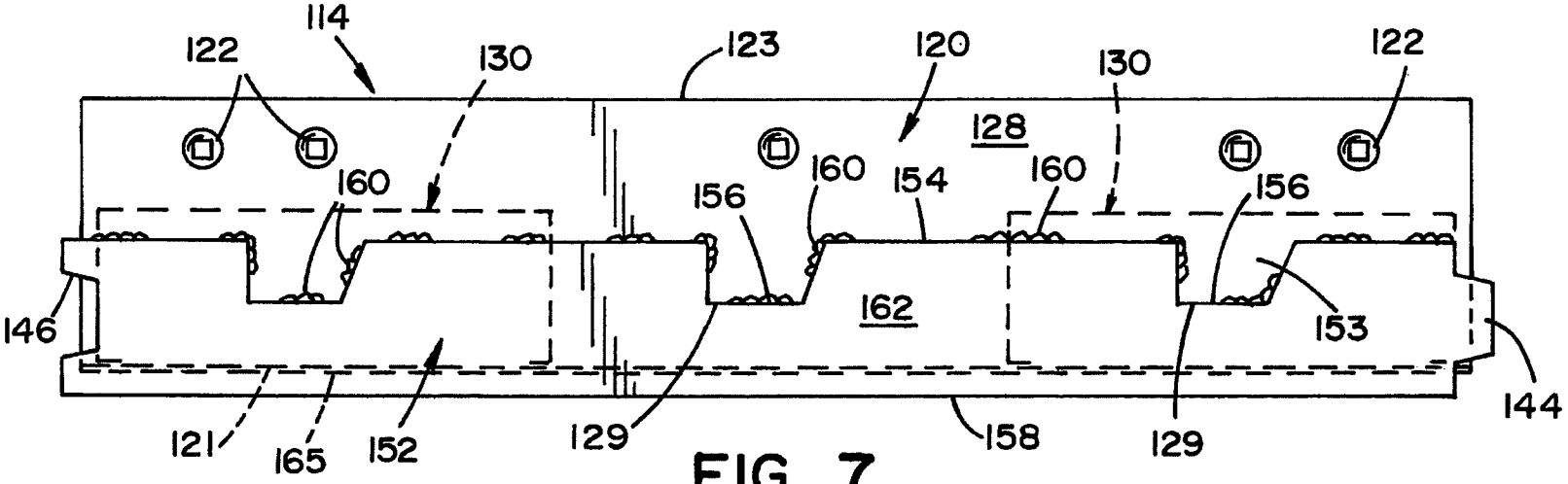
FIG. 7 displays a front view of the combination of a plow guard blade section and wear bar sections for the embodiment shown in FIG. 5.
Figure 8:
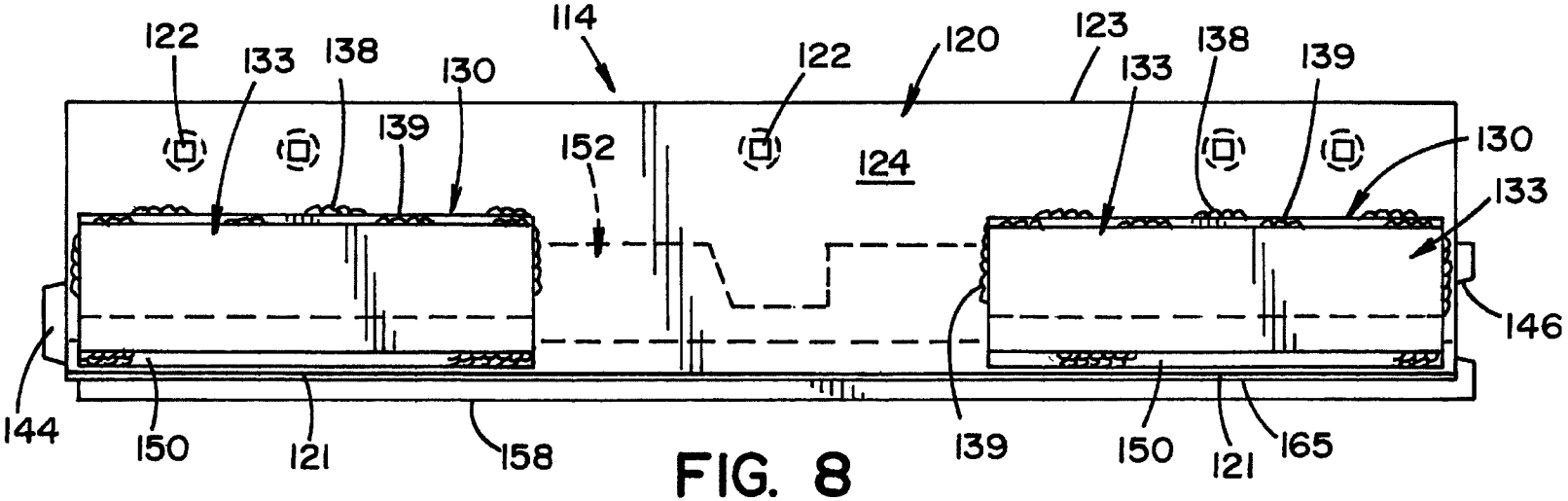
FIG. 8 displays a rear view of the combination of the plow guard blade section and wear bar sections for the embodiment shown in FIG. 5.

Referring now to FIG. 7, there is shown a wear termination or replacement line 129 on the steel cover plate 152, along a bottom edge 156 of the cut-out(s) 153. The wear replacement line 129 indicates when the plow blade edge system 114 should be replaced. The wear line 129 can be reached, for example, when all, or substantially all, of the carbide matrices 150 of the impact wear bar 130 have worn off, or abraded away. As described above, any number of combinations of plow edge blade sections 120 of exemplary lengths can be used to accommodate varying size of the plow blade body from 6 feet to 12 feet, et al. Each of the steel cover plates 152 can include a male tab 144 and a female notch 146 at opposing ends for interlocking of adjacent plow blade sections 120. The end 144 of steel cover plate 152 is designed to align with or interlock an adjacent end 146 of another cover plate 152 thereby stabilizing the plow blade edge system 114. Thus, the male interlock section 144 of one blade 120 can be interlocked with the female section 146 of another adjacent interlock blade 120. The male 144 and female 146 interlock sections overlap a joint of adjacent blade sections 120 thereby stabilizing the blade system 114. In conjunction therewith, one or more integral plow blade edge sections 114 can be independently mounted or replaced. In this manner, one person can single-handedly replace one (or more) integral plow blade edge sections 114 as needed in one simple section swap.

In another embodiment, the plow blade edge device 114 can further include a plow guard or curb guard (not illustrated) attached to the plow edge blade 120 and positioned along a front side 162 of the steel cover plate 152. The guards can provide even further protection and wear resistance to mold board 113 and plow body 112. The guards can also include a carbide matrix along a bottom edge for increased blade end protection.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A plow blade edge system, comprising;

a plurality of wear bars mounted to a rear side of a plow blade section body;

a first channel extending below each of the plurality of wear bars and partially defined by the plow blade section body;

wherein each wear bar includes a weldment of carbide matrix along a bottom edge of the each wear bar and forming a first wear surface, the weldment of carbide matrix being retained in the first channel; and the plow blade section body including a second channel formed in and extending along a bottom edge of the plow blade section body, the second channel being operative to receive at least one carbide insert and forming a second wear surface;

wherein a total surface area of the first wear surface exposed to an associated road surface is greater than a total surface area of the second wear surface exposed to the associated road surface.

2. The plow blade edge system as recited in claim 1, wherein the total surface area of the first wear surface exposed to the associated road surface is from about 1.0 to about 3.0 times the total surface area of the second wear surface exposed to the associated road surface.

3. The plow blade edge system as recited in claim 1, further comprising:

a retainer plate associated with each wear bar for forming a support edge for the first wear surface;

wherein the plurality of wear bars, the plow blade section body, and the retainer plates comprise an outline area relative to the road surface; and, wherein the combined surface area of the first wear surface and the second wear surface is from about 45 percent to about 75 percent of the outline area.

4. The plow blade edge system as recited in claim 3, wherein the combined surface area of the first wear surface and the second wear surface is from about 55 percent to about 70 percent of the outline area.

5. The plow blade edge system as recited in claim 3, wherein the combined surface area of the first wear surface and the second wear surface is from about 65 percent to about 70 percent of the outline area.

6. The plow blade edge system as recited in claim 1, wherein the combined wear bars, carbide matrix weldments, plow blade section body, and plurality of carbide inserts have a combined weight including a pound per square inch (PSI) factor representing the combined weight relative to a respective surface area footprint; and, the PSI factor is from about 1.0 PSI to about 1.80 PSI.

7. The plow blade edge system as recited in claim 6, wherein the resultant PSI factor is from about 1.20 PSI to about 1.60 PSI.

8. The plow blade edge system as recited in claim 6, wherein the resultant PSI factor is from about 1.30 PSI to about 1.55 PSI.

9. The plow blade edge system as recited in claim 1, wherein the first wear surface is co-planar with the second wear surface.

10. The plow blade edge system as recited in claim 1, further comprising:

a retainer plate for further defining the first channel between the retainer plate and the plow blade section body.

11. The plow blade edge system as recited in claim 10, wherein the retainer plate is secured to a wear bar.

12. The plow blade edge system as recited in claim 10, wherein the retainer plate is part of the wear bar.

13. The plow blade edge system of claim 1, wherein the plurality of wear bars with the weldments of carbide matrix and the at least one carbide insert provides from about 3.0 lbs/ft to about 4.5 lbs/ft of carbide matrix protection.

14. The plow blade edge system of claim 1, further comprising:

a retainer plate associated with the each wear bar, wherein a width or thickness of the retainer plate is less than a width or thickness of the weldment of carbide matrix.

15. The plow blade edge system of claim 1, further comprising:

wherein a width or thickness of a cutting edge of the wear bar is less than a width or thickness of the weldment of carbide matrix.

* * * * *